US008479727B2

(12) United States Patent
Grove et al.

(10) Patent No.: US 8,479,727 B2
(45) Date of Patent: Jul. 9, 2013

(54) ENHANCED CHEMICAL/BIOLOGICAL RESPIRATORY PROTECTION SYSTEM

(75) Inventors: Corey M. Grove, Red Lion, PA (US); David M. Caretti, Bel Air, MD (US); Stephen E. Chase, Jarrettville, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 1129 days.

(21) Appl. No.: 10/843,636

(22) Filed: May 4, 2004

(65) Prior Publication Data

US 2005/0247310 A1 Nov. 10, 2005

(51) Int. Cl.

| | |
|---|---|
| ***A62B 17/04*** | (2006.01) |
| ***A62B 23/02*** | (2006.01) |
| ***A62B 7/10*** | (2006.01) |

(52) U.S. Cl.

USPC ..... 128/201.25; 128/200.24; 128/201.22; 128/201.23

(58) Field of Classification Search

USPC ..... 128/200.28, 201.25, 201.29, 202.11, 128/205.28, 205.29, 857, 563, 201.22, 201.23, 128/201.24, 201.28, 202.19, 202.12, 205.26, 128/205.27, 205.22

See application file for complete search history.

(56) References Cited

U.S. PATENT DOCUMENTS

| | | | | | |
|---|---|---|---|---|---|
| 3,525,334 | A | * | 8/1970 | Scott et. al. | 128/201.25 |
| 3,736,927 | A | * | 6/1973 | Misaqi | 128/201.25 |
| 3,739,774 | A | * | 6/1973 | Gregory | 128/201.28 |
| 4,019,508 | A | * | 4/1977 | Der Estephanian et al. | 128/202.19 |
| 4,127,122 | A | * | 11/1978 | Kienhofer et al. | 128/201.25 |
| 4,197,841 | A | * | 4/1980 | Brauer et al. | 128/202.13 |
| 4,331,141 | A | * | 5/1982 | Pokhis | 128/204.28 |
| 4,430,995 | A | * | 2/1984 | Hilton | 128/204.21 |
| 4,590,951 | A | * | 5/1986 | O'Connor | 128/204.23 |
| 4,619,254 | A | * | 10/1986 | Moretti et al. | 128/201.23 |
| 4,676,236 | A | * | 6/1987 | Piorkowski et al. | 128/201.23 |
| 4,741,332 | A | * | 5/1988 | Beaussant | 128/201.23 |
| 4,901,716 | A | * | 2/1990 | Stackhouse et al. | 128/201.25 |
| 4,926,855 | A | * | 5/1990 | Hellquist et al. | 128/201.28 |
| H863 | H | * | 1/1991 | Kwiedorowicz et al. | 2/424 |
| 5,003,974 | A | * | 4/1991 | Mou | 128/201.25 |
| 5,036,842 | A | * | 8/1991 | van der Smissen et al. | 128/204.18 |
| 5,046,492 | A | * | 9/1991 | Stackhouse et al. | 128/200.27 |
| 5,078,130 | A | * | 1/1992 | Van Oosten et al. | 128/201.24 |
| 5,318,020 | A | * | 6/1994 | Schegerin | 128/205.12 |
| 5,394,870 | A | * | 3/1995 | Johansson | 128/205.22 |
| 5,427,090 | A | * | 6/1995 | Hipskind et al. | 128/205.12 |
| 5,555,879 | A | * | 9/1996 | Helin et al. | 128/201.24 |
| 5,577,496 | A | * | 11/1996 | Blackwood et al. | 128/201.25 |
| 5,950,621 | A | * | 9/1999 | Klockseth et al. | 128/204.26 |
| 6,102,034 | A | * | 8/2000 | Buhlmann | 128/201.29 |
| 6,302,105 | B1 | * | 10/2001 | Wickham et al. | 128/204.18 |
| 6,520,177 | B1 | * | 2/2003 | Bonhomme et al. | 128/201.28 |
| 6,752,146 | B1 | * | 6/2004 | Altshuler et al. | 128/201.25 |
| 6,763,835 | B1 | * | 7/2004 | Grove et al. | 128/857 |

(Continued)

*Primary Examiner* — Annette Dixon

(74) *Attorney, Agent, or Firm* — Ulysses John Biffoni

(57) ABSTRACT

The invention utilizes a chemical/biological hood with a filter-blower system that is attached to the chemical/biological hood. The filter-blower system provides overpressure to the hood only. The hood is fitted to or attached to a chemical/biological mask. Overpressure created by the filter-blower around the mask is created and is independent of the wearer's respiration so that over-breathing of the positive pressure is not possible. Typically this system would be available as a hood capable of providing enhanced protection. However, the filter-blower and hood system could be integrated with the mask. Cinching or sealing the hood at the neck can improve overpressure performance.

2 Claims, 2 Drawing Sheets

U.S. PATENT DOCUMENTS 6,837,239 B2 * 1/2005 Beizndtsson et al. .... 128/201.25
6,948,191 B2 * 9/2005 Avery et al. ..... 2/456
6,957,653 B2 * 10/2005 Campbell et al. ..... 128/206.21
7,007,690 B1 * 3/2006 Grove et al. ..... 128/201.25
7,311,102 B2 * 12/2007 Pears et al. ..... 128/201.24
2004/0226558 A1 * 11/2004 Kausch ..... 128/201.29

* cited by examiner

ENHANCED CHEMICAL/BIOLOGICAL RESPIRATORY PROTECTION SYSTEM

GOVERNMENT INTEREST

The invention described herein may be manufactured, used and licensed by or for the U.S. Government.

BACKGROUND OF THE INVENTION

1. Filed of the Invention

The invention provides for a novel chemical/biological protection enhancement system that is relatively inexpensive, lightweight, and could be tailored for civilian and military chemical/biological applications. No chemical/biological masks currently exist that use this process for protection enhancement. The invention uses a novel system that provides for very high levels of protection in known chemical/biological environments without the use of a self-contained breathing apparatus.

2. Brief Description of Related Art

Military and commercial chemical/biological masks fall into three general categories: negative pressure, positive pressure, and self-contained. Negative pressure masks utilize one or more filtration systems to process external filtered air into the wearer's respiratory air stream. Positive pressure units circulate external filtered air into the wearer's air stream using a fan or blower to pressurize the mask and minimize the leakage potential caused by negative pressure in the mask. Self-contained systems utilize an air source to supply or recycle air using an internal or enclosed process to shield the wearer from the environment. These are ideal for very high concentration chemical/biological environments or for environments where the elements are completely unknown. Many self-contained systems provide a level of positive pressure as well.

Negative pressure masks have limited protection capabilities. Protection factor results can range from little to no protection to 100,000:1 on a fully sealed mask. Even on a good sealing mask, leaks can be generated through facial movements, foreign matter in the seals, or through higher breathing rates. Table 1 is an example of a good sealing mask on a static head form. Protection factors are quite high at reduced breathing rates but decrease as the breathing rate increases.

TABLE 1

Example of the effects of increased ventilation rates on the fit factor performance of a negative pressure respirator.

| | Fit Factor (LogFF) | |
|---|---|---|
| Minute Volume | Eye | Nose |
| 18 liters/minute | 122236 | 104197 |
| 50 liters/minute | 56583 | 38835 |
| 85 liters/minute | 27082 | 29775 |

Eye = samplefrom the eye region of the respirator;
nose = sample from the oronasal cavity of the respirator.

Positive pressure masks offer the potential for increased protection factors. Protection factors can range from several thousand to well over 100,000:1 on a fully sealed mask. Tables 2-4 demonstrate the potential for increased protection factor using a variety of blower flow rates. Increasing the airflow into the mask will generally increase the protection factor of the mask. However, these protection factors are still influenced by breathing rates of the individual. Tables 2-4 demonstrate how increased breathing rates can significantly reduce the performance of a positive pressure system even on a fully sealed mask. When a user breathes faster due to higher work rates, the user can exceed the flow rate of the blower causing a negative pressure in the mask and additional seal leakage. This causes a negative pressure in the mask which brings air in from the outside.

TABLE 2

Mask fit factors both with and without a blower. Blower flow rates for the low, medium (med.), and high settings were approximately 38 L/min, 47 L/min, and 56 L/min. all data were collected with a ventilation rate of 18 L/min.

| | Fit Factor (LogFF) | |
|---|---|---|
| Mask Configuration | Eye | Nose |
| Unblown Mask | 122236 | 104197 |
| Mask with Blower (low) | 168318 | 364675 |
| Mask with Blower (med.) | 161902 | 624246 |
| Mask with Blower (high) | 358458 | 447432 |

TABLE 3

Mask fit factors both with and without a blower. All data were collected with a ventilation rate of 50 L/min.

| | Fit Factor (LogFF) | |
|---|---|---|
| Mask Configuration | Eye | Nose |
| Unblown Mask | 56583 | 38835 |
| Mask with Blower (low) | 79426 | 27815 |
| Mask with Blower (med.) | 61394 | 23880 |
| Mask with Blower (high) | 56434 | 20136 |

TABLE 4

Mask fit factors both with and without a blower. All data were collected with a ventilation rate of 85 L/min.

| | Fit Factor (LogFF) | |
|---|---|---|
| Mask Configuration | Eye | Nose |
| Unblown Mask | 27082 | 29775 |
| Mask with Blower (low) | 38176 | 20074 |
| Mask with Blower (med.) | 45828 | 24117 |
| Mask with Blower (high) | 46442 | 29384 |

Self-contained systems can provide very high protection factors well over 100,000:1. These systems are ideal for environments where the chemical/biological concentration is extremely high or where the hazard is completely unknown. Unfortunately, these systems are very limited in capacity. Wear times can range from several minutes to several hours. They are also very heavy and bulky, frequently requiring hoses and tanks. System weights can range from several pounds to 40 or 50 pounds depending on the system capacity.

Therefore, there is a need for a chemical/biological protection system that provides enhanced chemical/biological protection over conventional negative and positive pressure systems but is not as bulky as a self-contained system. There is also a need to provide a chemical/biological protection system that is still effective when a wearer's breathing rate increases.

Therefore, an object of the present invention is to provide a system that gives enhanced chemical/biological protection over conventional systems.

Another object of the invention is to provide a system that is not as bulky as a self-contained system but is more efficient that a negative pressure or positive pressure system.

Another object of the invention is to provide a system that compensates for increased breathing rates without sacrificing chemical or biological protection to the user.

These and other objects are met with the present invention that provides an improved protection factor that is independent of the wearer's breathing rate. The invention is a viable improvement over negative and positive pressure systems and offers a more stable protection level and can be easily adapted to almost any mask system.

SUMMARY OF THE INVENTION

The present invention solves the problems of the past chemical/biological protection systems by providing an enhanced protection to a user by adding a separate filter-blower system to a chemical/biological hood. The filter-blower system provides overpressure to the hood system only. This makes the overpressure independent of the wearer's respiration so that over-breathing of the positive pressure is not possible.

DETAILED DESCRIPTION

The invention utilizes a separate filter-blower system that is part of a chemical/biological hood. This chemical/biological hood provides overpressure to a chemical/biological mask system. The overpressure created is independent of the wearer's respiration so that over-breathing which pulls outside air into a chemical/biological mask is not possible as the hood remains under a positive pressure.

The filter-blower hood system of the invention is a chemical/biological hood capable of providing enhanced protection when it is integrated with a chemical/biological mask. Cinching or sealing of the secondary hood at the neck improves overpressure performance.

Figure 1:
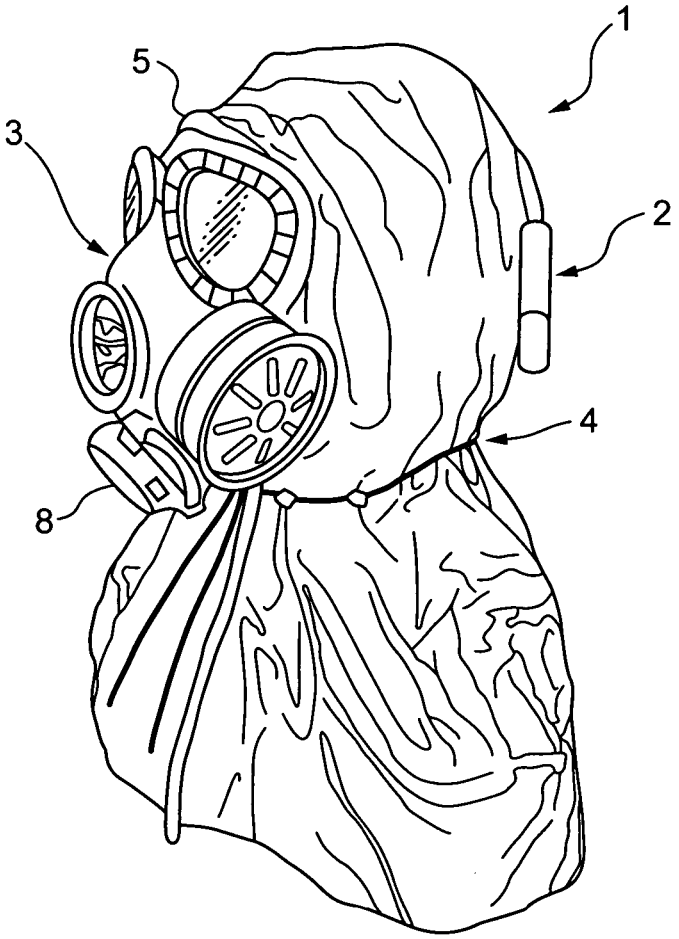
FIG. 1 is a perspective view of the system of the present invention showing a separate filter-blower that is a part of a chemical biological hood.
Figure 3:
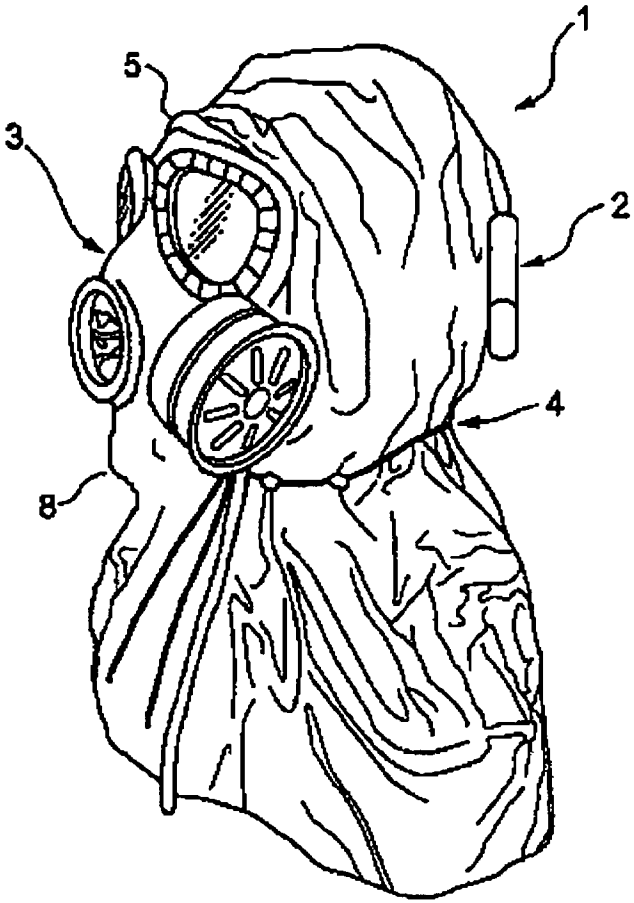
FIG. 3 is a perspective view of the system of the present invention showing the embodiment of the hood covering the exhalation valve.

In one embodiment of the invention as shown in FIG. 1, a hood 1 with a filter and blower 2 is placed over a primary chemical/biological mask 3. The chemical-biological mask 3 shown in FIG. 1 is a conventional negative pressure as mask having its own filter for filtering external air as the wearer inhales so that filtered air is provided to the interior of the mask. The hood is fixed over or to the outer face seal of the mask. In this embodiment, the chemical/biological hood 1 is cinched or sealed at the neck 4 to enclose the chemical/biological mask 3. The hood 1 includes a filter and a blower 2. The blower blows outside air through the filter and the filtered air enters the hood. This creates an overpressure of air around the chemical/biological mask 3 that prevents leaks of contaminated air into the chemical/biological mask. The chemical/biological hood would typically cover the face seal portion 5 of the chemical/biological mask but could also cover the exhalation valve 8 for additional protection. This embodiment where the hood 1 covers the exhalation valve 8 of the negative pressure mask 3 is depicted in FIG. 3.

The hood is made of a chemical/biological resistant material.

The filter-blower system 2 that is used with the invention would typically be lightweight and head mounted. This would eliminate the need for external hose and wire systems that are commonly worn on the body. The filter blower 2 would preferably be mounted in the back of the hood but could be mounted any other location that was convenient and comfortable. The filter-blower system would preferably provide up to 2 cubic feet per minute of clean air into the hood on a continuous basis.

Figure 2:
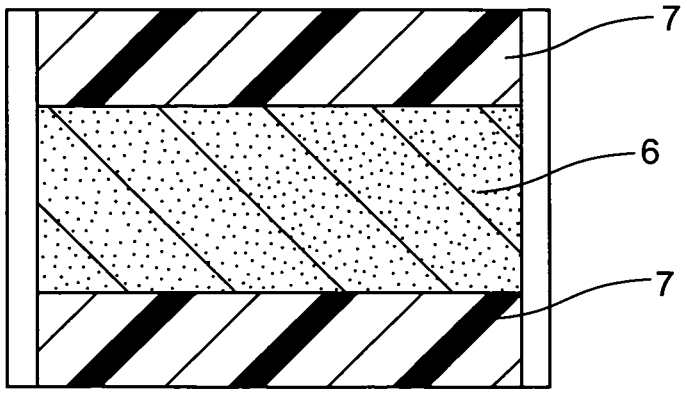
FIG. 2 is a schematic representation of the filter structure of the system.

A schematic representation of the filter structure is provided in FIG. 2. The filter has a carbon web 6 sandwiched between two layers of particulate media 7.

The filter is typically designed to provide a pressure drop in the range of 1" of $H_2O$ at a flow rate of 85 liters per minute. This allows the use of a small blower system suitable for head mounting. Typical surface areas for the filter are about 150-300 $cm^2$. The filters typically incorporate a carbon loaded web media for vapor filtration and an electrostatic media for particulate filtration but could utilize any low resistance, chemical/biological filtration media.

A typical blower is similar to Micronel Safety C301® which is small and lightweight and can provide the necessary flows to accommodate the filter head pressure.

The sorbent layers of this invention typically are made from a carbon-loaded web 6 shown in FIG. 2. An example of this media is 3M Carbon Loaded Web media. Carbon loading is accomplished using ground Calgon ASZM-TEDA carbon. This media offers excellent sorbent filtration and low pressure drop characteristics. The media can be loaded to 300 grams/$m^2$ of carbon and layered to provide the required chemical protection for almost any operation. Use of four (4) layers is preferred depending on the surface area of the filter. The minimum surface area of the sorbent filter ranges from 150 $cm^2$-300 $cm^2$. The preferred filter surface area for this hood is 250 $cm^2$ to 300 $cm^2$.

The particulate layers 7 shown in FIG. 2 are made from an electrostatic media. Particulate filtration media is included along with the carbon loaded web structure. An example of this media is 3M Advanced Electret Media (AEM). This media offers excellent aerosol filtration and very low pressure drop characteristics. The media is optimized to provide near HEPA performance at a depth of approximately 0.1 inches. The minimum surface area of the particulate filter can range from 150 $cm^2$ to 300 $cm^2$. The preferred surface area for this hood is 250 $cm^2$.

Edge sealing is accomplished either with a silicone adhesive sealant or a thermoplastic edge seal adhesive. Compressing stacked media in a mold and injecting edge seal material in a cavity around the stacked media creates edge seals. Edge seal sizes are about 0.25". An example of a sealant is BJB F60 polyurethane. This material offers fast curing cycles at low temperatures. Temperatures no greater than 150 degrees F. are required to prevent media degradation during the edge sealing operation.

Compress stacked media can be used as a filter. Stacking media in this fashion allows for the development of a low profile, thin bed filter that is more difficult to achieve with traditional packed bed technology.

The filter is edge sealed using a polyurethane sealant similar to the BJB sealant described above. This is continuous for any embodiment. The filter blower is bonded or clamped into the hood and the hood is fitted or secured to the mask. No sealing is required of the filter blower to the hood.

To further demonstrate the advantage of the invention, Tables 5 and 6 show fit factor results using this concept on a partially sealing mask. Table 5 shows results with a relatively loose fitting hood. Fit factors increase slightly but remain fairly stable under all test conditions. Table 6 demonstrates the performance with a tighter fitting hood in which the hood is cinched around the neck. In this case, protection factor results improve significantly for each test condition. As an alternate concept, exhaled air can be used to supplement the pressurization effect. Tables 7 and 8 demonstrate these results under similar test conditions. In this case, improvements are apparent under both loose and cinched hood conditions.

Fit Factor is a ratio of the outside concentration over the inside concentration. For example if the concentration of the external contaminant was 10 and the amount of contaminant sampled in the mask was 1. The fit factor would be 10:1.

It is preferred to use a hood with a draw string around the neck. A loose fitting hood in this example is a hood in which the draw string is not used. A cinched hood is one where the hood draw string is tightened.

TABLE 5

Fit factors with and without a loose fitting hood and blower for a mask with no known leaks in the face piece seal.

| | Fit Factor (LogFF) | |
|---|---|---|
| Mask Configuration | Eye | Nose |
| Mask with No Hood | 44041 | 12257 |
| Mask with Hood | 43428 | 21110 |
| Hood with Blower (low) | 44881 | 23620 |
| Hood with Blower (med.) | 48575 | 16492 |
| Hood with Blower (high) | 59494 | 35283 |

TABLE 6

Fit factor with and without the hood cinch around the neck and the blower for a mask with no known leaks in the face piece seal.

| | Fit Factor (LogFF) | |
|---|---|---|
| Mask Configuration | Eye | Nose |
| Mask with No Hood | 44041 | 12257 |
| Mask with Hood Cinched | 72223 | 27020 |
| Hood Cinched with Blower (low) | 71110 | 29861 |
| Hood Cinched with Blower (med.) | 81554 | 61320 |
| Hood Cinched with Blower (high) | 89750 | 88109 |

TABLE 7

Purged hood effects with a loose fitting hood on a mask with no leaks.

| | Fit Factor (LogFF) | |
|---|---|---|
| Mask Configuration | Eye | Nose |
| Mask | 44041 | 12257 |
| Exhale into Hood | 70165 | 24521 |
| Exhale into Hood with Blower (low) | 77530 | 46662 |
| Exhale into Hood with Blower (med.) | 79681 | 80362 |
| Exhale into Hood with Blower (high) | 74136 | 96078 |

TABLE 8

Purged hood effects with the hood cinched on a mask with no leaks

| | Fit Factor (LogFF) | |
|---|---|---|
| Mask Configuration | Eye | Nose |
| Mask | 44041 | 12257 |
| Exhale into Cinched Hood | 69189 | 40917 |
| Exhale into Cinched Hood with Blower (low) | 89487 | 49912 |
| Exhale into Cinched Hood with Blower (med.) | 85469 | 75662 |
| Exhale into Cinched Hood with Blower (high) | 108745 | 51047 |

Air is usually exhaled into the outside environment from a mask. The term purged hood means covering the exhalation valve and blowing exhaled air into the hood.

To better demonstrate the performance advantages of the invention, a leak was imposed in the mask seal. This highlights the advantage of the invention when compared to a traditional positive pressure system, which is dependent on the wearer's breathing pattern. Tables 9 and 10 demonstrate protection factor results with both loose and tighter (i.e. cinched) fitting hood conditions. These results demonstrate an ability to overcome a fairly large leak in the mask seal with a relatively small amount of overpressure. In the cinched hood condition, less airflow is generally needed to overcome the seal leak. Tables 11 and 12 demonstrate the same test conditions on an alternate configuration where exhaled air is used to supplement the purging effect. Although protection results tended to be lower, similar trends were observed.

Purging effect is the additional contribution caused by blowing exhaled air into the hood.

TABLE 9

Fit factors with and without a loose fitting hood and blower for a mask with a known leak in the face piece seal.

| | Fit Factor (LogFF) | |
|---|---|---|
| Mask Configuration | Eye | Nose |
| Mask with Leak | 192 | 143 |
| Mask with Hood | 255 | 212 |
| Hood with Blower (low) | 5705 | 5727 |
| Hood with Blower (med.) | 22211 | 23569 |
| Hood with Blower (high) | 76848 | 55433 |

TABLE 10

Fit factors with and without the hood cinched around the neck and the blower for a mask with known leaks in the face piece seal.

| | Fit Factor (LogFF) | |
|---|---|---|
| Mask Configuration | Eye | Nose |
| Mask with Leak | 192 | 143 |
| Cinched Hood | 371 | 295 |
| Cinched Hood with Blower (low) | 85139 | 49895 |
| Cinched Hood with Blower (med.) | 72629 | 53689 |
| Cinched Hood with Blower (high) | 87419 | 50092 |

TABLE 11

Purged hood effects with a loose fitting hood on a mask with a known leak.

| Mask Configuration | Fit Factor (LogFF) Eye | Nose |
|---|---|---|
| Mask with Leak | 192 | 143 |
| Exhale into Hood | 1475 | 1246 |
| Exhale into Hood with Blower (low) | 16570 | 12492 |
| Exhale into Hood with Blower (med.) | 60201 | 69571 |
| Exhale into Hood with Blower (high) | 62864 | 54827 |

TABLE 12

Purged hood effects with the hood cinched on a mask with a leak.

| Mask Configuration | Fit Factor (LogFF) Eye | Nose |
|---|---|---|
| Mask with Leak | 192 | 143 |
| Exhale into Cinched Hood | 26282 | 15914 |
| Exhale into Cinched Hood with Blower (low) | 40231 | 32473 |
| Exhale into Cinched Hood with Blower (med.) | 46201 | 31498 |
| Exhale into Cinched Hood with Blower (high) | 43562 | 36352 |

To further demonstrate the advantages of this invention, one additional test was performed. A traditional positive pressure approach in which the blower is placed in the wearer's respiration cycle was tested using a mask with a similar leak in the seal. Table 13 demonstrates these results at a breathing rate of 50 liters/minute. In general, the results indicate a limited ability to overcome the leak. Higher breathing rates would further reduce fit factor performance.

Table for FIG. 13.
Standard positive pressure performance of a mask with a known leak.

| Mask Configuration | Fit Factor (LogFF) Eye | Nose |
|---|---|---|
| Mask with Blower (low) | 1231 | 576 |
| Mask with Blower (med.) | 1649 | 566 |
| Mask with Blower (high) | 5446 | 794 |
| Mask with Blower (low) and Exhale into Hood | 7944 | 3387 |
| Mask with Blower (med.) and Exhale into Hood | 19693 | 6607 |
| Mask with Blower (high) and Exhale into Hood | 48081 | 20851 |

In comparison, Table 14 demonstrates the same conditions when using the filter blower hood as described in this invention. Fit factors are much higher since they are not affected by the wearer's breathing. Fit factors would also be more stable regardless of the breathing rate used to perform the test.

TABLE 14

Invention performance on a mask with a known leak

| Mask Configuration | Fit Factor (LogFF) Eye | Nose |
|---|---|---|
| Mask with Hood | 461 | 265 |
| Mask with Blown Hood (low) | 83786 | 76818 |
| Mask with Blown Hood (med.) | 87874 | 63648 |
| Mask with Blown Hood (high) | 91361 | 127658 |

In conclusion, the invention demonstrates an increased ability to stabilize protection using an improved positive pressure device. This arrangement is much more independent of wearer breathing cycles and has the ability to overcome many leaks that might be imposed from facial movement or foreign matter. As a result, the invention offers a means to extend the performance envelope of a negative or positive pressure mask. This could lead to use in operational performance scenarios otherwise only considered for self-contained systems.

What is claimed is:

1. A chemical-biological protection system, comprising:

a chemical-biological protection mask having outer edges;

a chemical-biological protection hood fitted around said outer edges of said chemical-biological mask;

a filter and blower connected to said hood for blowing filtered air only into said hood and providing an overpressure only around said outer edges of said mask, and wherein said overpressure that is created by said blower is created independent of the wearer's respiration, and is independent and separate from the filtered air being supplied to the interior of said mask.

2. The chemical-biological protection system of claim 1, wherein there are no external hoses attached to said hood.

* * * * *